US005945612A

United States Patent [19]

Yang

[11] Patent Number: 5,945,612

[45] Date of Patent: Aug. 31, 1999

[54] MUSIC CRYSTAL BALL STRUCTURE CAPABLE OF ROTATING IN ALTERNATING DIRECTIONS

[75] Inventor: Shin Ya Yang, Hsin Tieu, Taiwan

[73] Assignee: Ya Yung Enterprise Co., Ltd., Taipei Hsien, Taiwan

[21] Appl. No.: 09/098,838

[22] Filed: Jun. 17, 1998

[51] Int. Cl.[6] ..... G10F 1/06

[52] U.S. Cl. ..... 84/97; 84/98; 84/99

[58] Field of Search ..... 84/94.1, 95.1, 84/95.2, 94.2, 97, 98, 99

[56] References Cited

U.S. PATENT DOCUMENTS 5,011,451 4/1991 Hiltier ..... 446/409
5,424,484 6/1995 Chen ..... 84/95.1
5,696,333 12/1997 Shih ..... 84/95.2
5,814,749 9/1998 Sui et al. ..... 84/600

*Primary Examiner*—William M. Shoop, Jr.
*Assistant Examiner*—Kim Lockett
*Attorney, Agent, or Firm*—Pro-Techtor International Services

[57] ABSTRACT

A music crystal ball structure capable of rotating in alternating directions. A music bell serves as a power source for transmitting power to a mutilated gear which further transmitting the power to a gear member having inner circumferential teeth and outer circumferential teeth. The gear member is driven to rotate in alternating directions. For example, the gear member is counterclockwise rotated through an angle and then clockwise rotated through another angle. Such movement is circularly repeated to form a "forward 3, backward 1" state. By means of more than one set of gears, the decorative articles installed in the crystal ball and driven by the gear member can act like dancing opposite to each other and create a dynamic live view.

3 Claims, 6 Drawing Sheets

MUSIC CRYSTAL BALL STRUCTURE CAPABLE OF ROTATING IN ALTERNATING DIRECTIONS

BACKGROUND OF THE INVENTION

The present invention relates to a music crystal ball structure capable of rotating in alternating directions. The music crystal ball includes a mutilated gear and a specific gear member having inner circumferential teeth and outer circumferential teeth. The gear member serves to drive decorative articles installed in the crystal ball to lively and dynamically act.

In a generally seen music crystal ball, a decorative article is able to continuously rotate in one direction. Such rotational action is monotonous without variation and fails to attract a consumer.

SUMMARY OF THE INVENTION

It is therefore a primary object of the present invention to provide a music crystal ball structure capable of rotating in alternating directions. In the music crystal ball, a music bell serves as a power source for transmitting power to a mutilated gear which further transmitting the power to a gear member having inner circumferential teeth and outer circumferential teeth. The gear member is driven to rotate in alternating directions. For example, the gear member is counterclockwise rotated through 250 degrees and then clockwise rotated through 80 degrees. Then the gear member is again counterclockwise rotated through 250 degrees. Such movement is circularly repeated to form a "forward 3, backward 1" rotational action. By means of another set of gears, the decorative articles installed in the crystal ball and driven by the gear member can act like dancing opposite to each other and create a dynamic live view for attracting a consumer.

The present invention can be best understood through the following description and accompanying drawings, wherein:

DETAILED DESCRIPTION OF THE PREFERRED EMBODIMENTS

Figure 1:
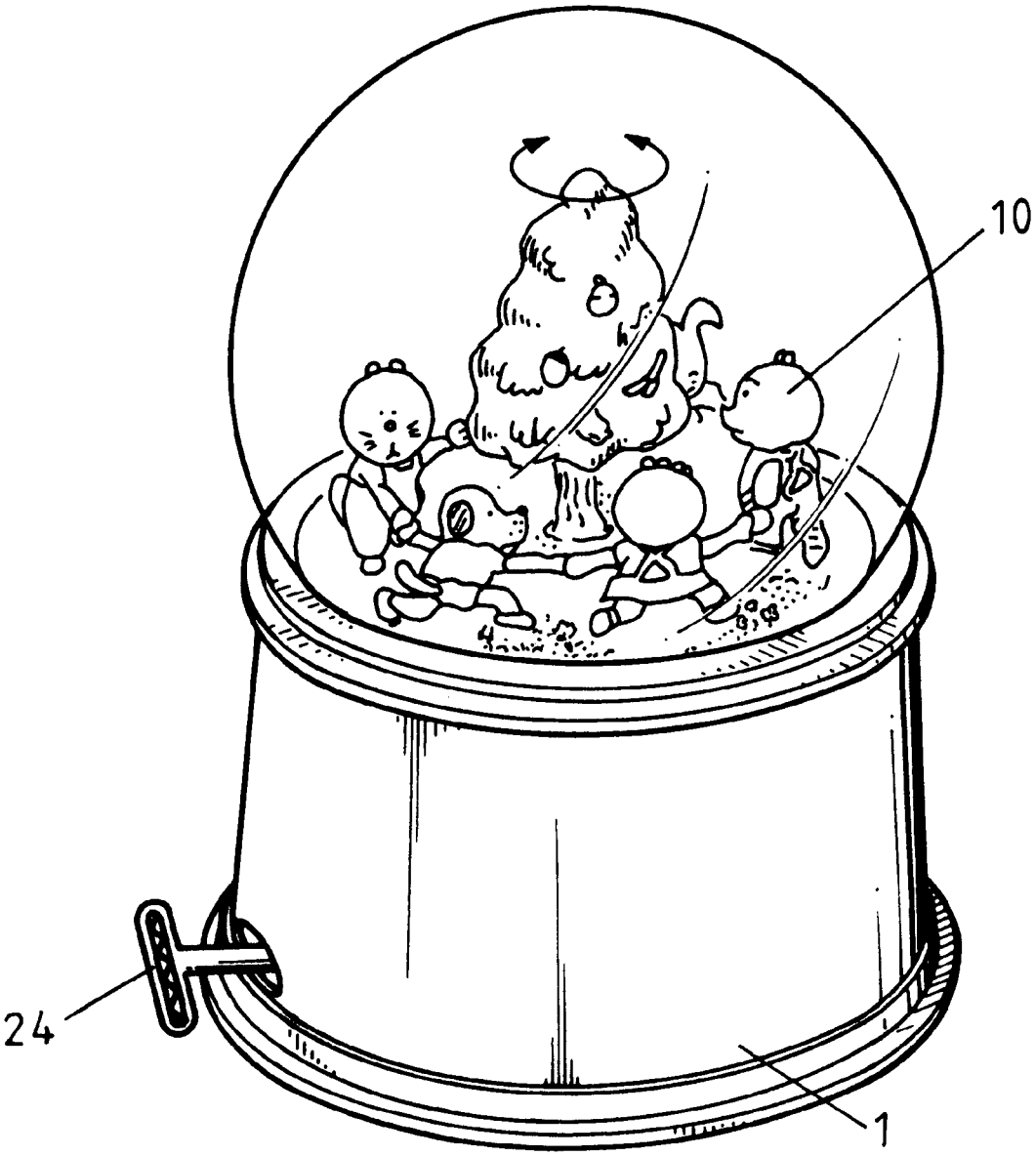
FIG. 1 is a perspective view of the music crystal ball of the present invention.
Figure 2:
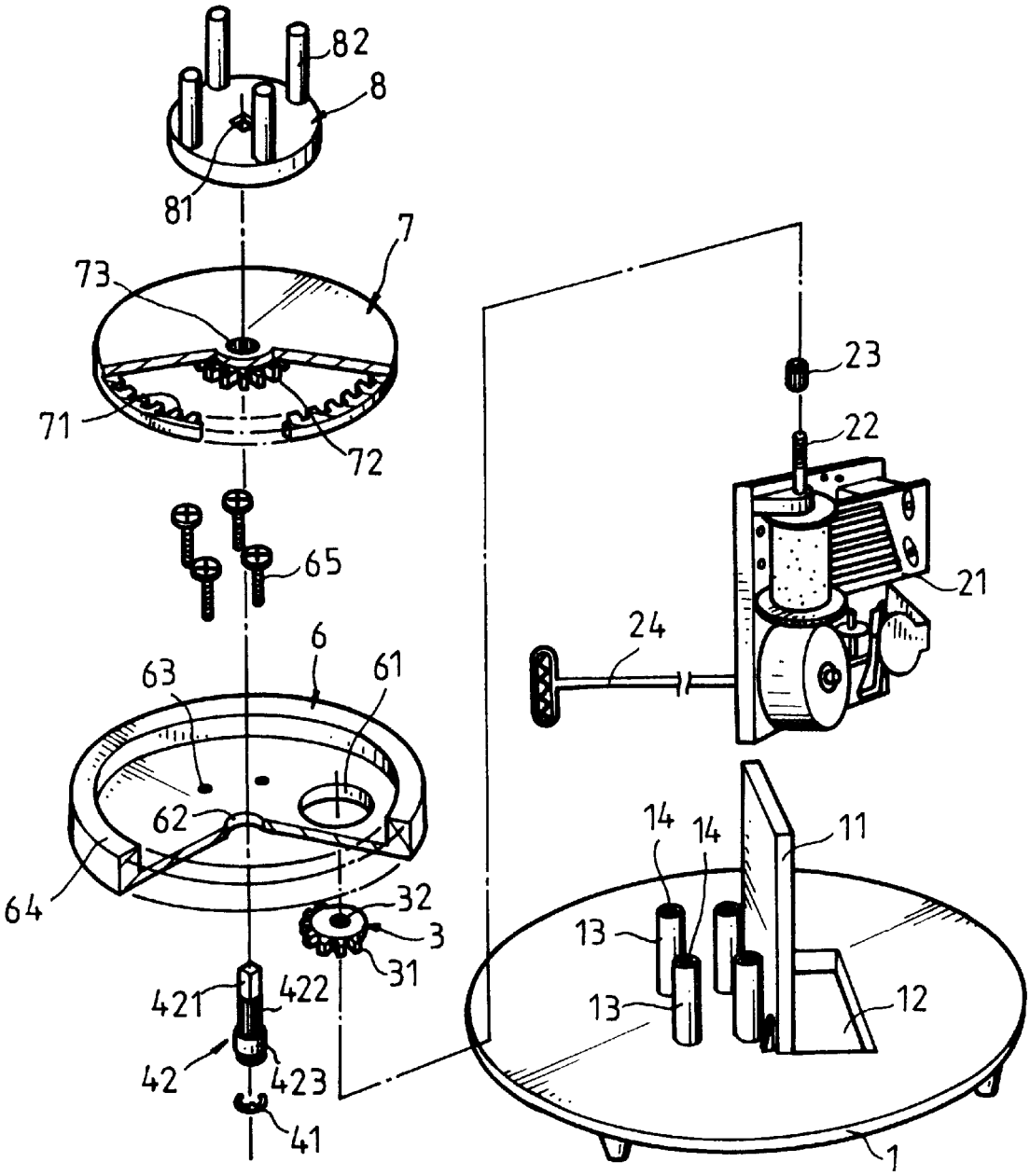
FIG. 2 is a perspective exploded view of the present invention.
Figure 3:
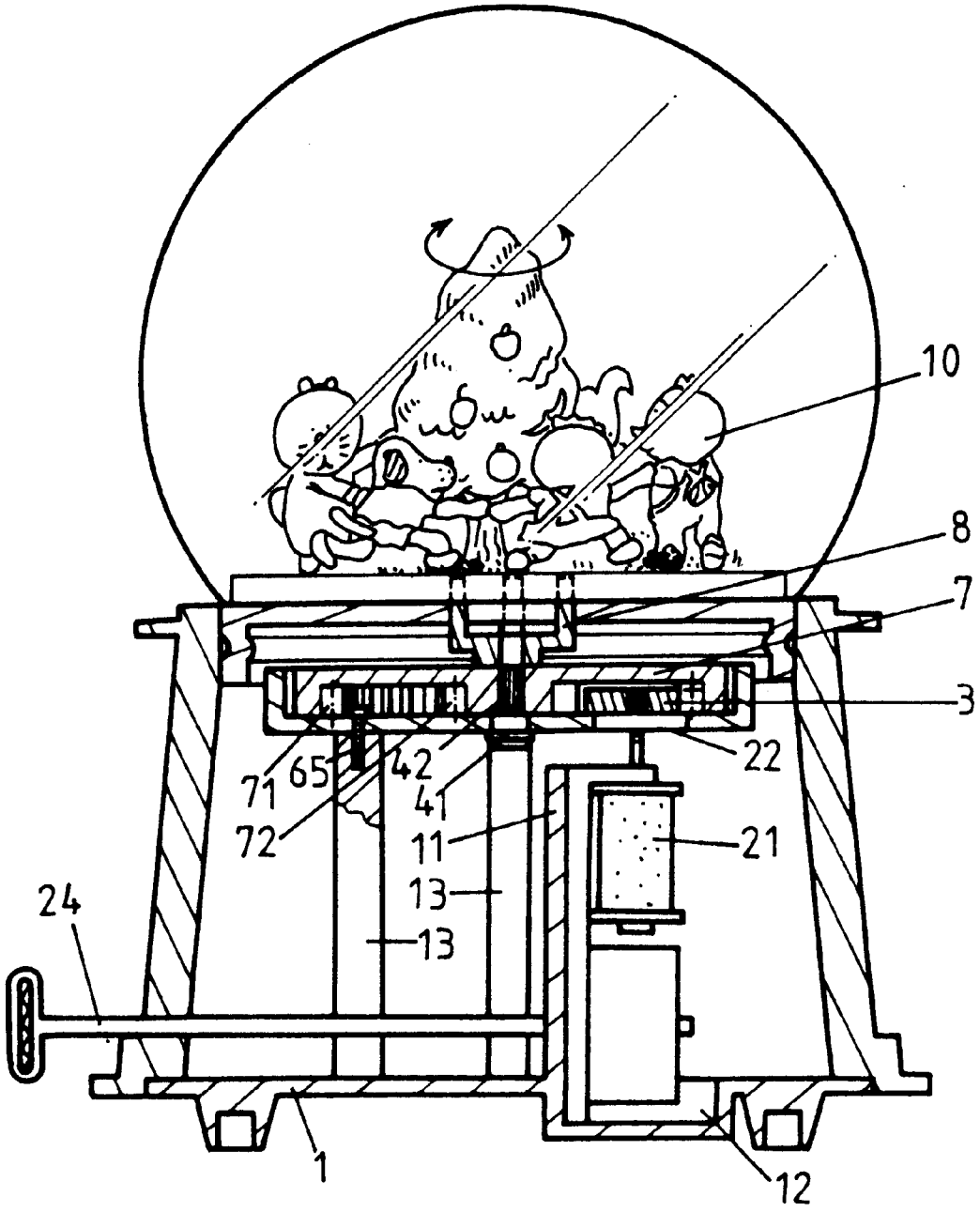
FIG. 3 is a sectional assembled view of the present invention.

Please refer to FIGS. 1, 2 and 3. The present invention includes a fixing board 1 disposed with four upright supporting posts 13. The top end of each supporting post 13 is formed with a small hole 14 for fixing a music bell 21 on the fixing board 1 in an upright state. A rotary shaft 24 laterally extends from the music bell 21 for winding the music bell. In addition, the fixing board 1 is formed with a recess 12, whereby a lower section of the music bell 21 is fitted in the recess 12. A front stopper wall 11 is disposed on front edge of the recess 12, whereby the music bell 21 can lean against the stopper wall 11. A transmission shaft 22 extends out of the music bell 21. A front thread section of the transmission shaft 22 is screwed into a thread hole of a copper sleeve 23. The outer periphery of the copper sleeve 23 is formed with engaging teeth, whereby when the copper sleeve 23 is fitted with a mutilated gear 3, the engaging teeth are tightly engaged in a toothed central hole 32 of the mutilated gear 3, so that the power can be transmitted from the music bell 21 through the transmission shaft 22 to the mutilated gear 3.

Figure 5:
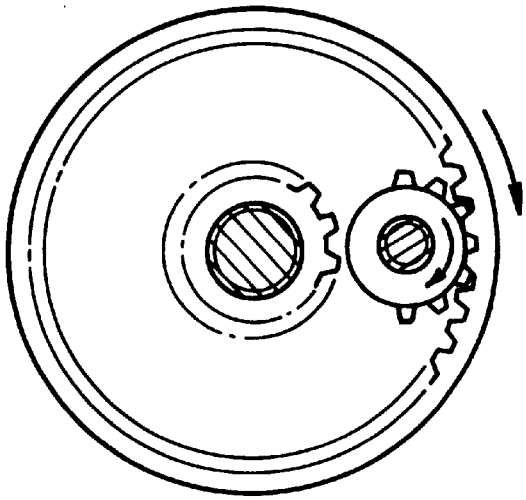
FIG. 5 shows the engagement between the mutilated gear and the gear member of the present invention in another state.
Figure 4:
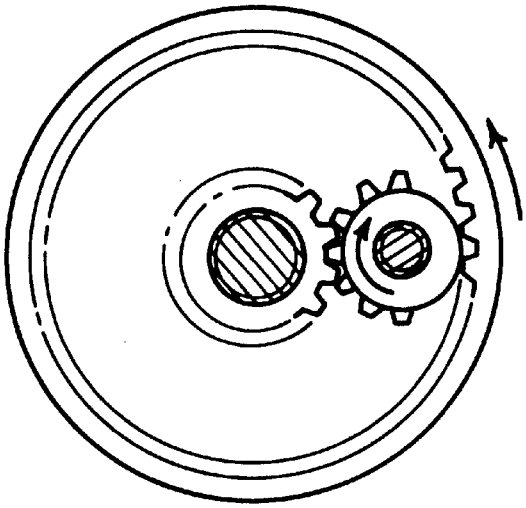
FIG. 4 shows the engagement between the mutilated gear and the gear member of the present invention in one state.

The mutilated gear 3 is engaged with a specifically designed gear member 71. Please refer to FIGS. 2 to 5. The gear member 71 is substantially disc-shaped, including inner circumferential teeth 71 formed on inner side of the circumference of the disc and outer circumferential teeth 72 formed around a central shaft hole 73 of the disc. The inner teeth 71 and the outer teeth 72 are integrally connected with the gear member 7. Referring to FIGS. 4 and 5, when the teeth 31 of the mutilated gear 3 are engaged with the inner teeth 71 of the gear member 7 and the mutilated gear 3 is rotated clockwise (seen from upper side), the gear member 7 is driven to rotate also in clockwise direction. Following the continuous rotation of the mutilated gear 3, the teeth 31 thereof are gradually disengaged from the inner teeth 71 and further engaged with the outer teeth 72. At this time, the gear member 7 is driven to rotate in a reverse direction, that is, counterclockwise direction. Following the continuous rotation of the mutilated gear 3, the teeth 31 are disengaged from the outer teeth 72 and further engaged with the inner teeth 71. At this time, the gear member 7 is again rotated clockwise. Therefore, the gear member 7 is repeatedly rotated in alternating directions.

The present invention is characterized in that the operation of the gear member 7 is different from the left and right symmetrical swinging movement. The generally seen swinging movement is that the member is clockwise rotated through an angle and then counterclockwise rotated through an equal angle. However, when the teeth 31 of the mutilated gear 3 are engaged with the inner teeth 71 of the gear member 7, the gear member 7 is driven to rotate through a first angle. When the teeth 31 of the mutilated gear 3 are engaged with the outer teeth 72 of the gear member 7, the gear member 7 is driven to rotate through a second angle. The former is less than the latter and the ratio of the first angle to the second angle is about d (the diameter of the dividing circle of the outer teeth) : D (the diameter of the dividing circle of the inner teeth). Due to the difference between the movements, the operation effect of the decorative article 10 driven by the gear member 7 will be different from the general swinging movement. That is, the decorative article 10 will first rotate through the second angle and then rotate back through the first angle and then rotate forward through the second angle and then rotate back through the first angle. In the case that the decorative article 10 is seen from one single direction, the front, back, left and right sides of the decorative article 10 can be all eventually all seen. The decorative article 10 will thus form a "forward 3, backward 1" view.

As shown in FIG. 2, a supporting tray 6 is disposed under the gear member 7 for placing the gear member 7 therein. One side of the supporting tray 6 is formed with a through hole 61 for the mutilated gear 3 to pass therethrough to engage with the inner and outer teeth 71, 72 of the gear member 7. In addition, the periphery of the supporting tray 6 is formed with four small holes 63 for four screws 65 to pass therethrough to tighten the supporting tray 6 on the fixing posts 13 of the fixing board 1. A central transmission shaft 42 has an upper rectangular head 421 inserted in a central rectangular hole 81 of a four-claw tray 8. A middle section 422 thereof is disposed with outer teeth for tightly fitting in the central hole 73 of the gear member 7 for transmitting torque. A lower section 423 thereof is slidably fitted in the central hole 62 of the supporting tray 6 for restricting radial displacement thereof. After assembled, the four-claw tray 8, gear member 7 and the supporting tray 6 are serially connected to the central transmission shaft 42. The bottom end thereof is engaged with an engaging spring 41 for restricting axial displacement thereof. FIG. 3 shows that the present invention is applied to a crystal ball to continuously change direction of the rotation so as to create a dynamic and unique appearance.

Figure 6:
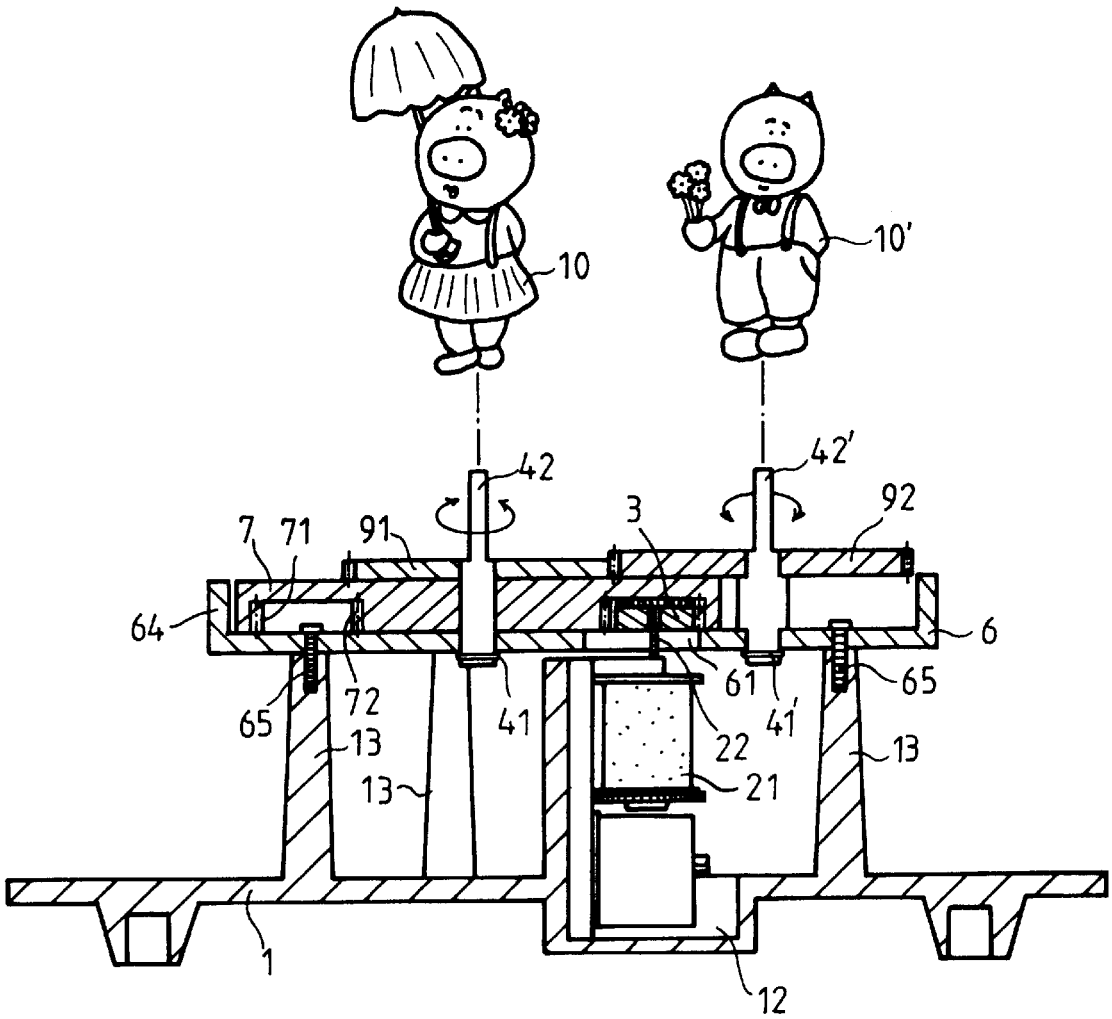
FIG. 6 is a sectional view of the present invention, showing that two decorative articles act like dancing opposite to each other.

Referring to FIG. 6, the upper end of the central transmission shaft 42 is further connected with a gear 91 horizontally meshing with another gear 92 having a central transmission shaft 42'. Accordingly, two decorative articles driven by the central transmission shafts 42, 42' can act like dancing opposite to each other.

Figure 7:
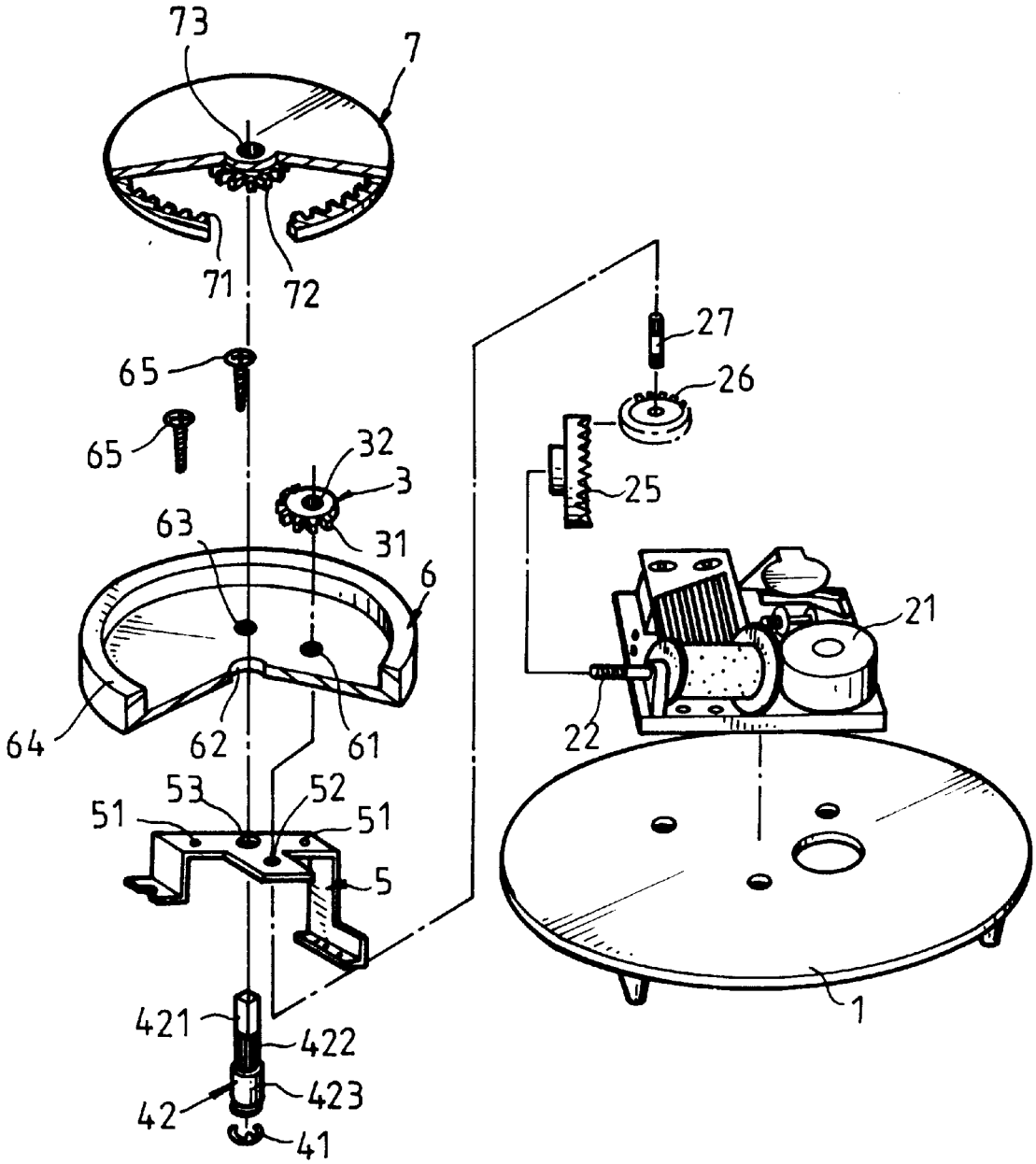
FIG. 7 is a perspective exploded view of another embodiment of the present invention.

FIG. 7 shows another embodiment of the present invention, in which the structure is simplified and the volume is reduced. The fixing board 1 is simplified to only provide fixing effect for the music bell 21. The transmission shaft 22 of the music bell 21 is directly connected with an end face gear 25 which perpendicularly meshes with a gear 26. The gear 26 via a short shaft 27 is connected with the mutilated gear 3 for transmitting power. The mutilated gear 3 then is engaged with the gear member 7 so that the gear member 7 can continuously rotate in alternating directions. The supporting tray 6 via screws 65 and through holes 63 are fixed on a bridge support 5. The gear 26 and the mutilated gear 3 are restricted via the short shaft 27 passing through the small hole 61 and the through hole 52. The bridge support 5 is fixed via the thread holes of the music bell 21. The central hole 53 thereof coincides with the central axis of the music bell 21. Also, the central axes of the gear member 7 and the transmission shaft 42 coincide with the central axis of the music bell 21. Such structure is symmetrical about the center and the respective parts are positioned within the circumferential range of the music bell 21 (generally 60 mm) so that such structure is applicable to various kinds of artistic works with small volume and can be easily assembled and disassembled.

It is to be understood that the above description and drawings are only used for illustrating some embodiments of the present invention, not intended to limit the scope thereof. Any variation and derivation from the above description and drawings should be included in the scope of the present invention.

What is claimed is:

1. A music crystal ball structure capable of rotating in alternating directions, comprising:

a fixing board disposed with several supporting posts, a top end of each supporting post being formed with a small hole for fixing a supporting tray thereon, the fixing board being formed with a recess, whereby a lower section of the music bell is fitted in the recess, a front stopper wall being disposed on front edge of the recess, whereby the music bell leans against the stopper wall, a rotary shaft laterally extending from the music bell for winding the music bell;

a mutilated gear engaged with a transmission shaft extending out of the music bell, one side of the circumference of the mutilated gear being disposed with several teeth, while the other side thereof being free from any tooth, a front thread section of the transmission shaft being screwed into a thread hole of a copper sleeve, an outer periphery of the copper sleeve being formed with engaging teeth, whereby when the copper sleeve is fitted with the mutilated gear, the engaging teeth are tightly engaged in a toothed central hole of the mutilated gear, so that the power can be transmitted from the music bell through the transmission shaft to the mutilated gear;

a gear member substantially disc-shaped, including inner circumferential teeth formed on inner side of the circumference of the disc and outer circumferential teeth formed around a central shaft hole of the disc, the inner teeth and the outer teeth being integrally connected with the gear member, whereby when the teeth of the mutilated gear are engaged with the inner teeth of the gear member, the gear member is driven to rotate in the same direction as the mutilated gear and reversely, when the teeth of the mutilated gear is engaged with the outer teeth, the gear member is driven to rotate in a direction reverse to that of the mutilated gear, following the continuous rotation of the mutilated gear, the teeth thereof are disengaged from the outer teeth and further engaged with the inner teeth, at this time, the gear member being again rotated in the same direction as the mutilated gear;

a supporting tray disposed under the gear member for placing the gear member therein, one side of the supporting tray being formed with a through hole for the mutilated gear to pass therethrough to engage with the inner and outer teeth of the gear member, a periphery of the supporting tray being formed with several small holes for screws to pass therethrough to tighten the supporting tray on the fixing posts of the fixing board;

a central transmission shaft having an upper rectangular head inserted in a central rectangular hole of a four-claw tray, a middle section thereof being disposed with outer teeth for tightly fitting in the central hole of the gear member for transmitting torque, a lower section thereof being slidably fitted in the central hole of the supporting tray for restricting radial displacement thereof, after assembled, the four-claw tray, gear member and the supporting tray being serially connected to the central transmission shaft, a bottom end thereof being engaged with an engaging spring for restricting axial displacement thereof.

2. A music crystal ball structure as claimed in claim 1, wherein an upper end of the central transmission shaft is further connected with a gear horizontally meshing with another gear having a central transmission shaft, whereby two decorative articles driven by the central transmission shafts can act like dancing opposite to each other.

3. A music crystal ball structure as claimed in claim 1, wherein the structure is such simplified that the fixing board is simplified to only provide fixing effect for the music bell, the transmission shaft of the music bell being directly connected with an end face gear which perpendicularly meshes with a gear, the gear via a short shaft being connected with the mutilated gear for transmitting power, the mutilated gear then being engaged with the gear member so that the gear member can continuously rotate in alternating directions, the supporting tray via screws and through holes being fixed on a bridge support, the gear and the mutilated gear being restricted via the short shaft passing through the small hole and the through hole, the bridge support being fixed via the thread holes of the music bell, the central hole thereof coinciding with the central axis of the music bell, the central axes of the gear member and the transmission shaft coinciding with the central axis of the music bell, whereby the respective parts are positioned within the circumferential range of the music bell so as to simplify and minimize the structure.

* * * * *